US010183185B2

(12) United States Patent
Carroccia et al.

(10) Patent No.: US 10,183,185 B2
(45) Date of Patent: Jan. 22, 2019

(54) FALL ARREST APPARATUS

(71) Applicant: On Top Safety Company, Inc., Cheektowaga, NY (US)

(72) Inventors: John J. Carroccia, Orchard Park, NY (US); Jeffrey L. Murray, Hamburg, NY (US)

(73) Assignee: On Top Safety Company, Inc., Cheektowaga, NY (US)

( * ) Notice: Subject to any disclaimer, the term of this patent is extended or adjusted under 35 U.S.C. 154(b) by 9 days.

(21) Appl. No.: 15/432,224

(22) Filed: Feb. 14, 2017

(65) Prior Publication Data

US 2017/0232280 A1 Aug. 17, 2017

Related U.S. Application Data

(60) Provisional application No. 62/295,859, filed on Feb. 16, 2016.

(51) Int. Cl.
*A62B 35/04* (2006.01)
*A62B 35/00* (2006.01)

(52) U.S. Cl.
CPC ..... *A62B 35/04* (2013.01); *A62B 35/0006* (2013.01); *A62B 35/0043* (2013.01); *A62B 35/0068* (2013.01)

(58) Field of Classification Search
CPC ..... B60T 1/14; A62B 35/00; A62B 35/0068; A62B 35/04; A62B 35/0006; A62B 35/0043; B62M 1/10; B62M 1/32; B62M 1/132; F16D 63/006; F16D 2127/008
USPC ..... 182/3; 280/212
See application file for complete search history.

(56) References Cited

U.S. PATENT DOCUMENTS 4,210,209 A * 7/1980 van der Lely ..... A01B 61/042 172/103
4,318,284 A * 3/1982 van der Lely ..... F16D 9/10 464/33
5,025,847 A * 6/1991 Mueller ..... E06B 9/13 160/133
5,310,284 A * 5/1994 Snowberger ..... E02B 7/44 405/102
5,501,411 A * 3/1996 Brum ..... B63B 21/56 242/397
5,836,535 A * 11/1998 Brum ..... B64D 3/02 242/381.5

(Continued)

OTHER PUBLICATIONS www.raptorsafety.com; TriRex brochure; undated.

(Continued)

*Primary Examiner* — Katherine W Mitchell
*Assistant Examiner* — Shiref M Mekhaeil
(74) *Attorney, Agent, or Firm* — Simpson & Simpson, PLLC

(57) ABSTRACT

A fall arrest apparatus including a force damping subsystem having a damper, a brake release mechanism connected to the force damping subsystem and arranged to trigger when a force having a sufficient magnitude is transmitted to the brake release mechanism, and a brake mechanism including an energy storage device arranged to deploy at least one anchor when the brake release mechanism is triggered. The force is provided by a falling object to the force damping subsystem and the force damping subsystem is arranged to decelerate the falling object after the brake release mechanism is triggered.

13 Claims, 15 Drawing Sheets

(56) References Cited

U.S. PATENT DOCUMENTS 6,035,970 A * 3/2000 Conte ..... B62M 1/105 185/39
6,227,553 B1 * 5/2001 Palmer ..... A62B 35/0068 280/47.18
6,820,880 B2 * 11/2004 Benton ..... B62B 5/0026 180/212
6,979,043 B2 * 12/2005 Leischner ..... B25B 13/48 296/98
7,207,414 B2 * 4/2007 Luke ..... A62B 35/0056 182/3
7,658,348 B1 * 2/2010 Braly ..... B64C 1/26 244/119
8,240,431 B2 8/2012 Smith
8,584,798 B2 * 11/2013 Stoffels ..... A62B 99/00 182/3
9,675,824 B2 * 6/2017 MacKarvich ..... A62B 35/0068
2006/0185800 A1 * 8/2006 Beaudoin ..... E05D 13/1269 160/191
2007/0289811 A1 * 12/2007 Smith ..... A62B 35/04 182/3
2008/0067772 A1 * 3/2008 Weagle ..... B62K 25/286 280/124.134
2009/0084631 A1 * 4/2009 Casebolt ..... A62B 1/10 182/235
2011/0084158 A1 * 4/2011 Meillet ..... A62B 1/08 242/385.4
2011/0100761 A1 * 5/2011 Dudde ..... B66B 5/18 187/359
2014/0090927 A1 * 4/2014 Patton ..... A62B 35/0068 182/112
2015/0352380 A1 * 12/2015 Huang ..... A62B 1/10 188/65.3
2017/0001834 A1 * 1/2017 Studer ..... B66B 5/16
2017/0167194 A1 * 6/2017 Freberg ..... E06B 9/82

OTHER PUBLICATIONS

Stinger Mobile Fall Protection Cart brochure, AES Raptor Stinger Mobile Fall Protection Unit; undated.

AES Raptor Stinger Instruction Manual, published by AES Raptor, LLC, North Kansas City, MO, Copyright 2010 by AES Raptor, LLC; undated.

BrochureTriRex, AES Raptor TriRex Mobile Fall Protection System brochure; undated.

AES Raptor TriRex Mobile Fall Protection System Anchorage Unit Instruction Manual, published by AES Raptor, LLC, North Kansas City, MO, Copyright 2010 by AES Raptor, LLC; undated.

* cited by examiner

FALL ARREST APPARATUS

CROSS-REFERENCE TO RELATED APPLICATIONS

This patent application claims the benefit under 35 U.S.C. § 119(e) of U.S. Provisional Patent Application No. 62/295,859, filed Feb. 16, 2016, which application is incorporated herein by reference.

FIELD

The invention broadly relates to a fall prevention device, more specifically to a fall prevention cart having an attached fall arrest system, and even more particularly to a fall prevention cart having an attached fall arrest system initiated by a falling object, e.g., a roofing construction worker, and actuated by an energy storage device, e.g., a torsion spring.

BACKGROUND

Fall prevention or fall arrest systems are known in the art. For example, one such system is disclosed in U.S. Pat. No. 8,240,431. This patent discloses a roofing worker safety device that delivers a resistive force in response to a worker falling from an elevated work surface such as a roof via a safety cable connecting the worker to the safety device. In this device, the cable transmitting the force of the falling worker to the device activates an arrestor arm that is forced into the surface on which the safety device is placed thereby stopping the fall of a worker from the roof. Although this device may prevent a worker from falling from an elevated height, the fall arrest system is dependent upon and in fact fully actuated by the weight of the falling worker. In other terms, the weight of the falling worker is solely responsible for the actuation of the arrestor arm. Various other means of arranging such fall arrest systems have been developed.

As can be derived from the variety of devices and methods directed at arresting the fall of an object from an elevated height, many means have been contemplated to accomplish the desired end, i.e., safety for the worker or object secured to the fall arrest system and safety for people and property below the area where workers or other objects may fall. Heretofore, tradeoffs between safety and cost were required. Thus, there is a long-felt need for a fall arrest system that is easy to operate, inexpensive to build and performs repeatably for the safety of all people and property on a work site.

SUMMARY

The present invention broadly comprises a fall arrest apparatus including a force damping subsystem having a damper, a brake release mechanism connected to the force damping subsystem and arranged to trigger when a force having a sufficient magnitude is transmitted to the brake release mechanism, and a brake mechanism including an energy storage device arranged to deploy at least one anchor when the brake release mechanism is triggered. The force is provided by a falling object to the force damping subsystem and the force damping subsystem is arranged to decelerate the falling object after the brake release mechanism is triggered.

The present invention also broadly comprises a method of arresting a fall of an object. The method including: a) transmitting a force via a connection between the object and a force damping subsystem; b) transmitting the force to a brake release mechanism via a connector arranged between the force damping subsystem and the brake release mechanism, the connector including a first side oppositely disposed relative to a second side; c) triggering the brake release mechanism via the force transmitted from the force damping subsystem; d) actuating a brake mechanism with an energy storage device; and, e) absorbing the force with the force damping subsystem.

Furthermore, the present invention broadly comprises a fall arrest apparatus including a force damping subsystem, a brake release mechanism, a connector and a brake mechanism. The force damping subsystem includes a damper, a first mounting bracket having a through bore and a first compression surface, and a first shaft slidingly disposed within the through bore of the first mounting bracket. The brake release mechanism is arranged to trigger when a force having a sufficient magnitude is transmitted to the brake release mechanism. The brake release mechanism includes a second mounting bracket, a second shaft having a first end opposite a second end, the second shaft slidingly disposed within the second mounting bracket, the second end including a through bore, a third mounting bracket having a through bore, a pawl including a first end opposite a second end, the first end having a through bore, a ratchet including a plurality of teeth engageable by the pawl, and a shear pin. The connector includes a first side oppositely disposed relative to a second side and fixedly connecting the force damping subsystem to the brake release mechanism. The brake mechanism is arranged to deploy at least one anchor when the brake release mechanism is triggered. The brake mechanism includes an energy storage device, at least one fourth mounting bracket, a fourth shaft disposed within the at least one fourth mounting bracket, and at least one anchor fixedly secured to the fourth shaft. The force is provided by a falling object to the force damping subsystem and the force damping subsystem is arranged to decelerate the falling object after the brake release mechanism is triggered. The damper includes a damper length, the first shaft is fixedly secured to the first side of the connector, the first side of the connector forming a second compression surface, the damper length is less than the distance between the first and second compression surfaces prior to triggering the brake release mechanism. The second shaft is fixedly secured to the second side of the connector, the through bore of the second shaft is in registered alignment with the through bore of the pawl, the shear pin is disposed within the through bore of the second shaft and the through bore of the pawl, and the brake release mechanism is triggered upon fracture of the shear pin. The energy storage device rotates the fourth shaft thereby deploying the at least one anchor.

Moreover, the present invention broadly comprises a force damping system including a bracket, a shaft and a damper. The bracket is fixedly secured to an object, and the bracket includes a first surface. The shaft is slidingly secured to the bracket. The shaft includes a first shaft end operatively arranged to connect to a falling object, and a second shaft end having a stop. The damper includes a first damper end abutting against the first surface, and a second damper end abutting against the stop.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION

Figure 1:
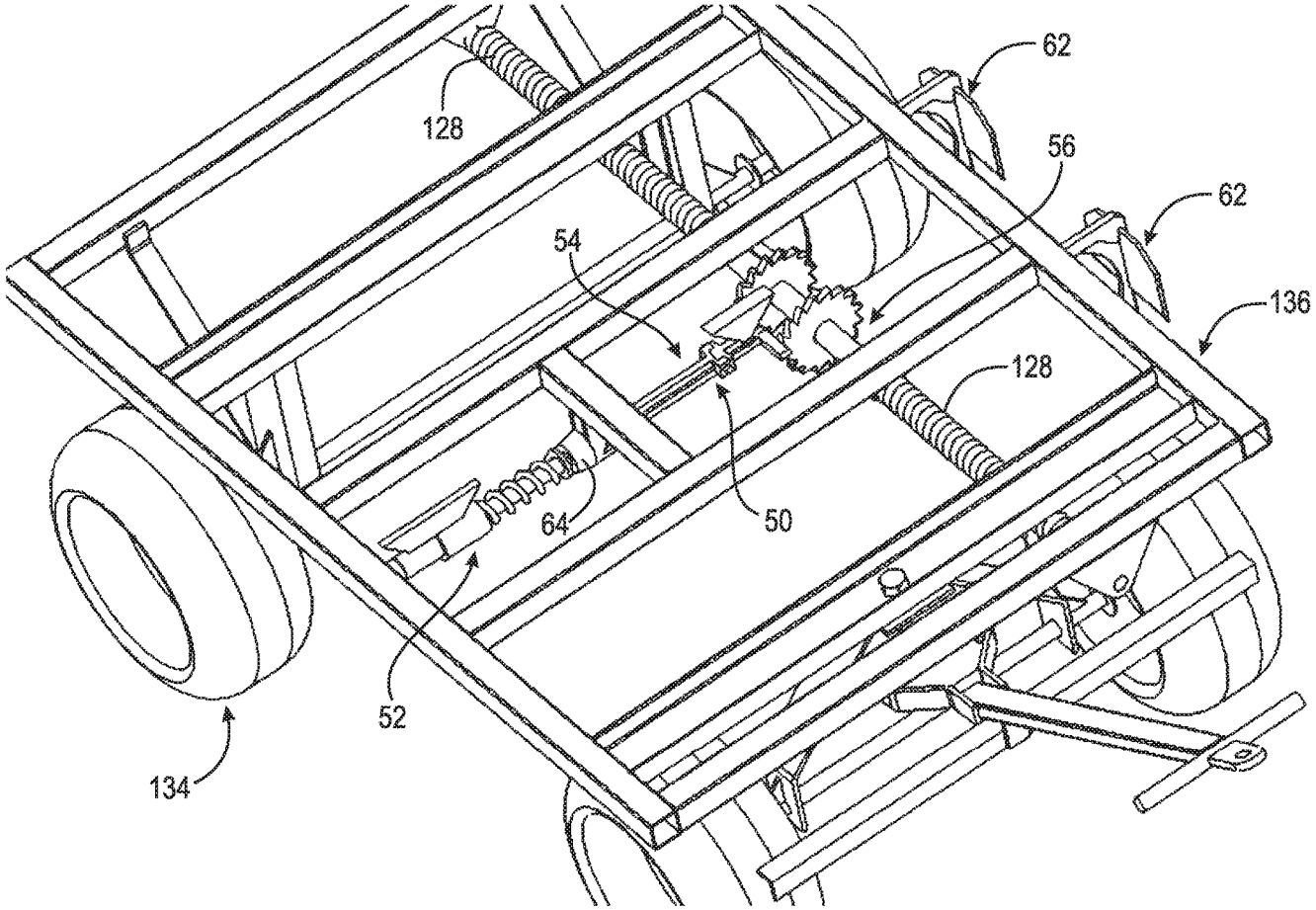
FIG. 1 is a front top perspective view of a cart having an embodiment of a present fall arrest apparatus secured to the underside of the cart.
Figure 2:
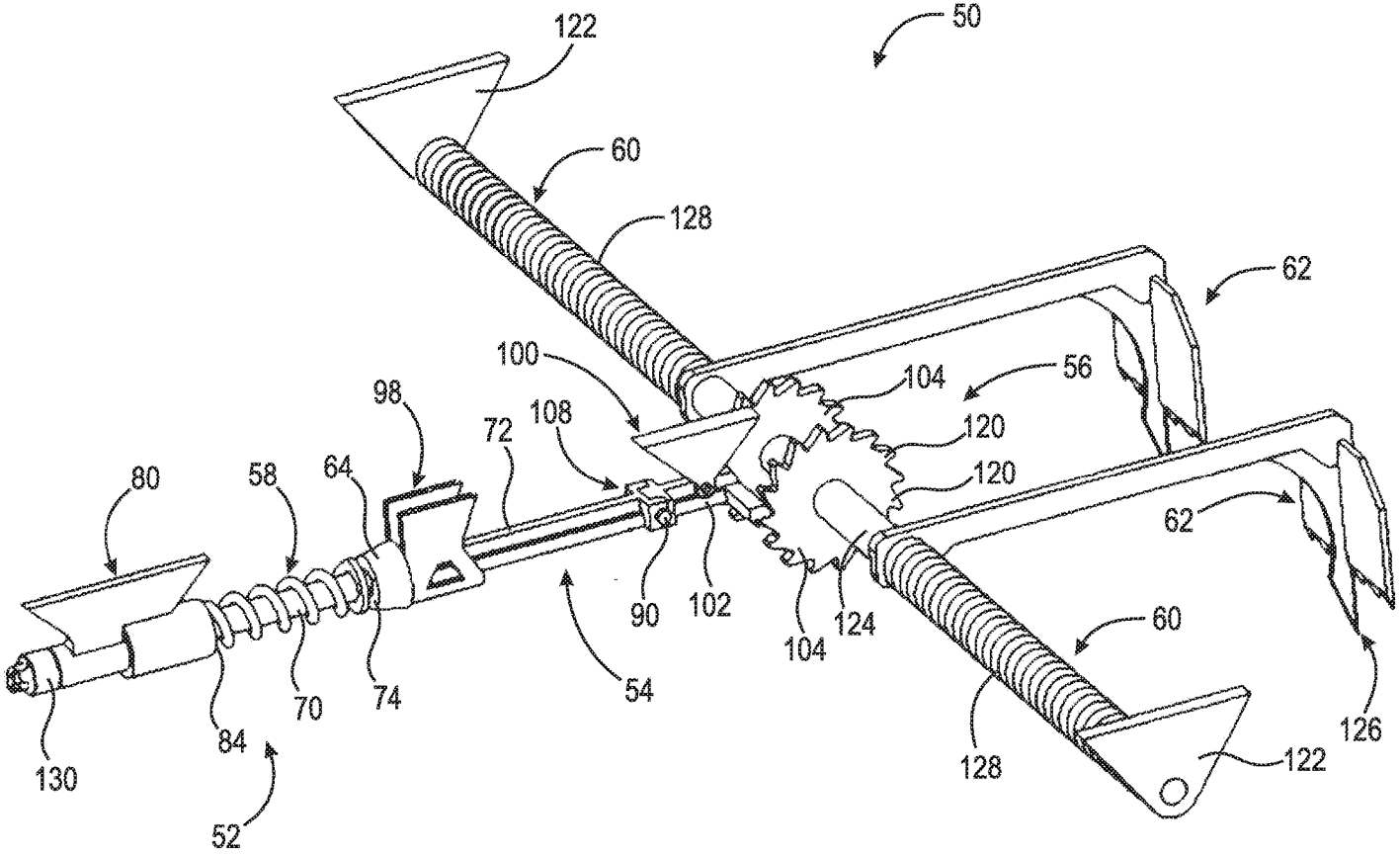
FIG. 2 is a top perspective view of an embodiment of a present fall arrest apparatus.
Figure 3:
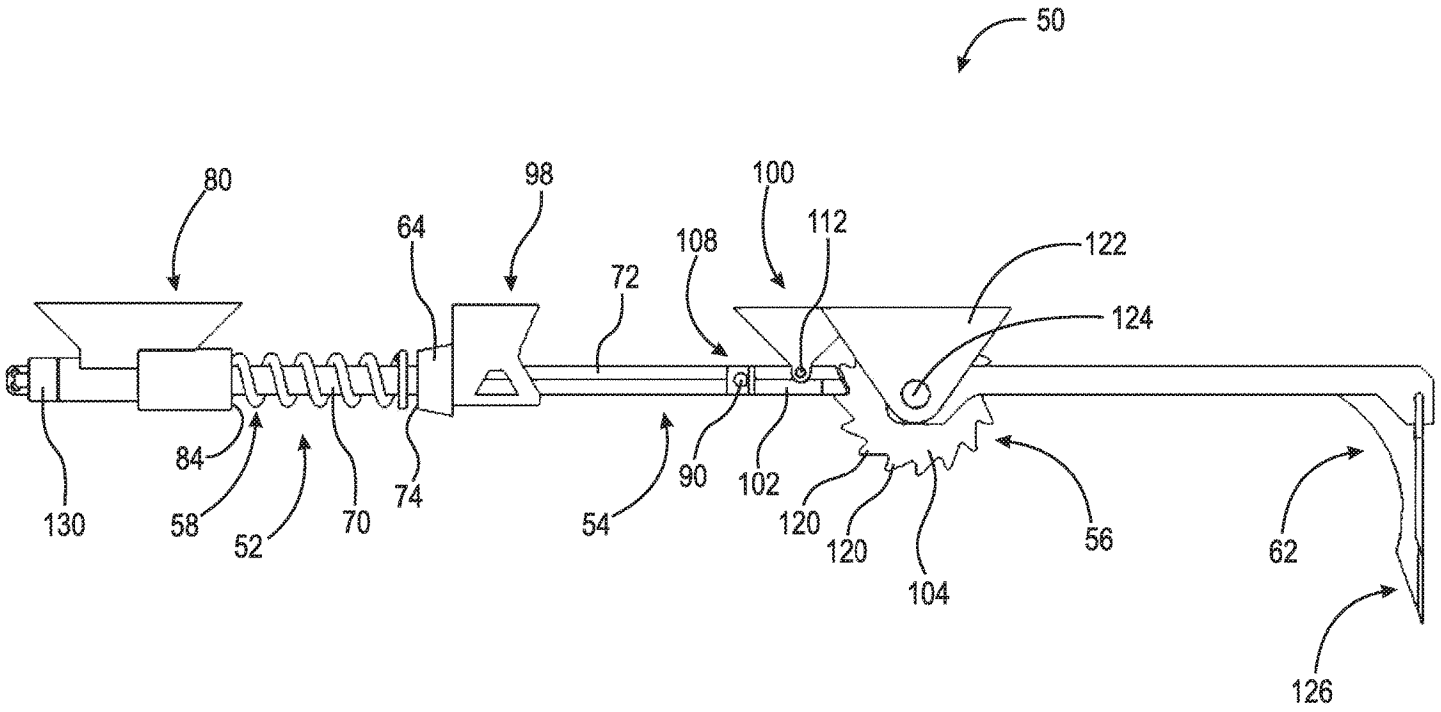
FIG. 3 is a side elevational view of an embodiment of a present fall arrest apparatus.
Figure 4:
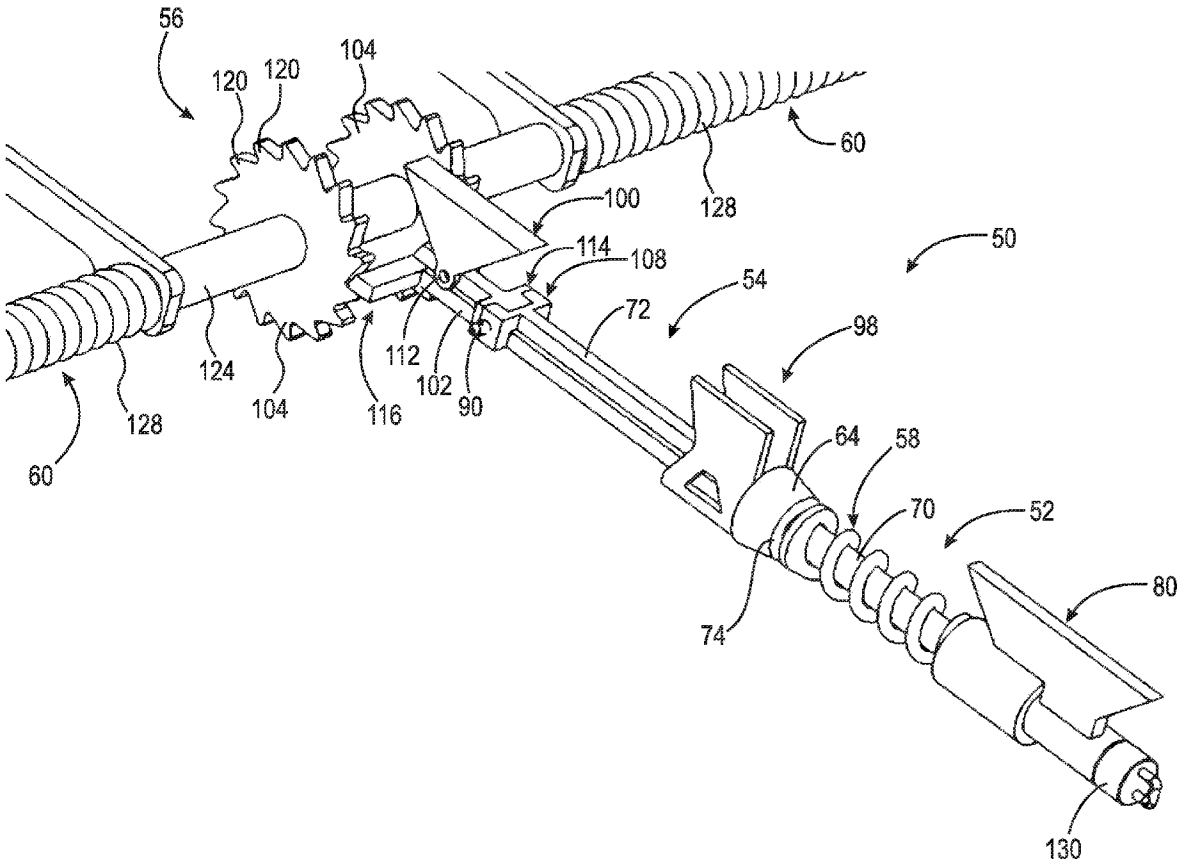
FIG. 4 is a partial top perspective view of an embodiment of a present fall arrest apparatus.
Figure 5:
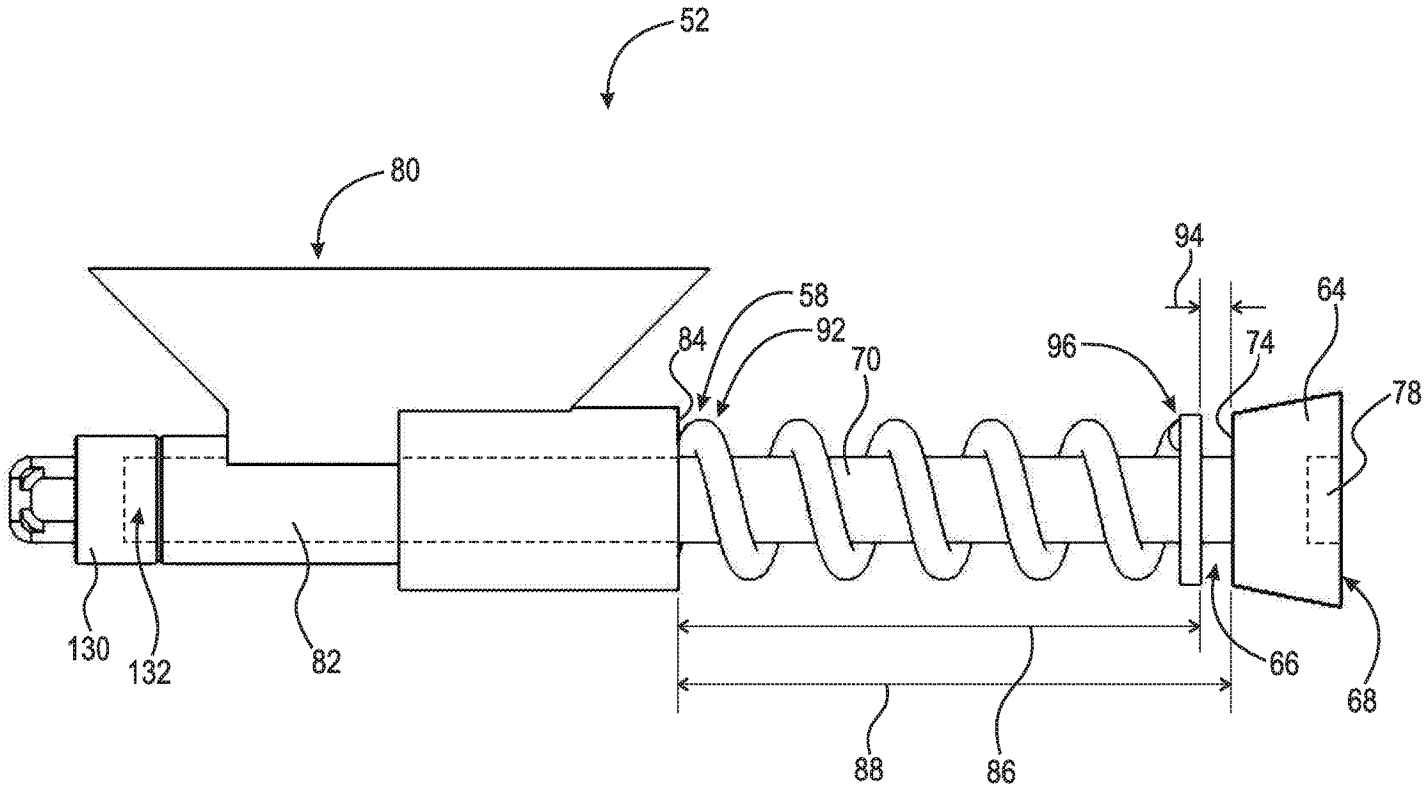
FIG. 5 is a side elevational view of an embodiment of a force damping subsystem used in a present fall arrest apparatus.
Figure 6:
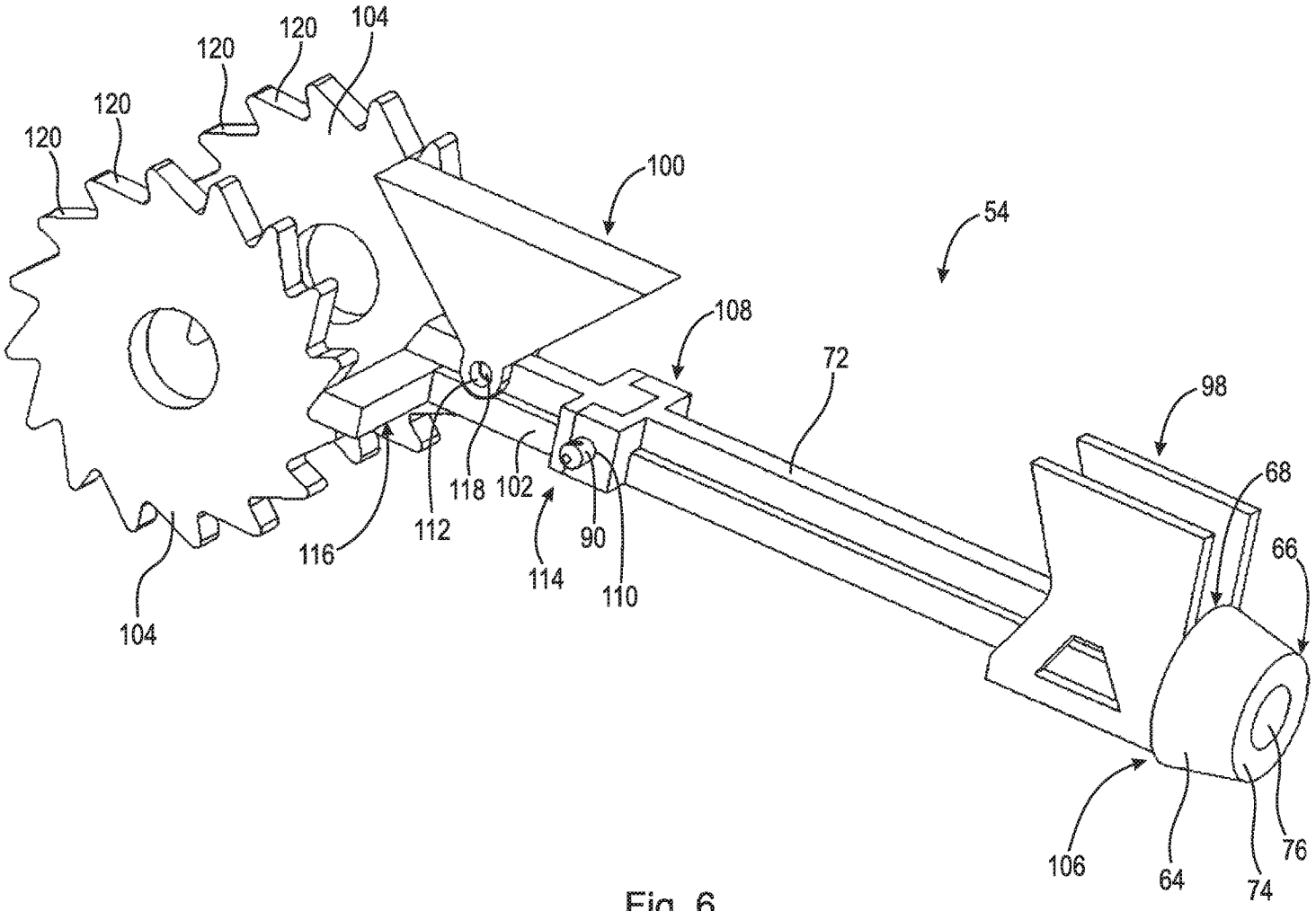
FIG. 6 is a top perspective view of an embodiment of a brake release mechanism used in a present fall arrest apparatus.
Figure 7:
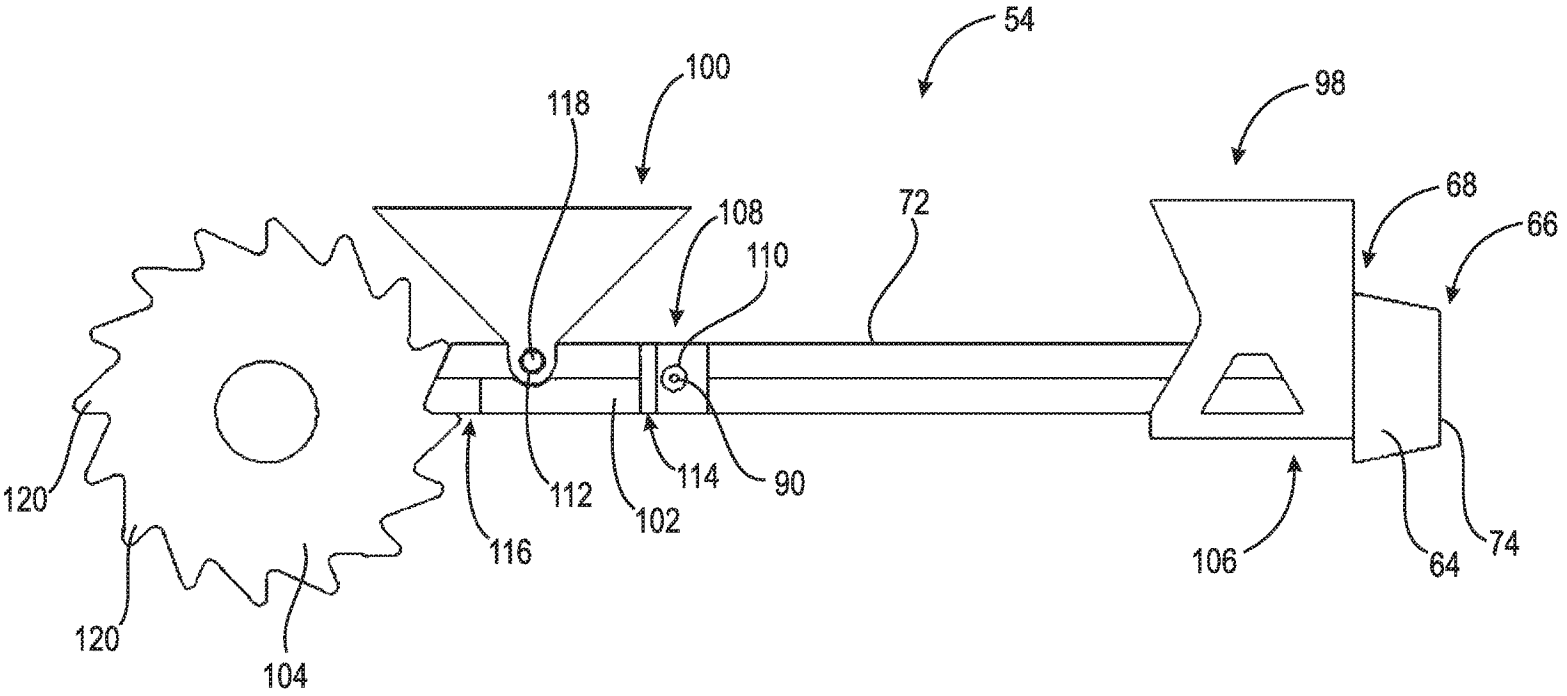
FIG. 7 is a side elevational view of an embodiment of a brake release mechanism used in a present fall arrest apparatus.

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

It should be appreciated that the term "substantially" is synonymous with terms such as "nearly," "very nearly," "about," "approximately," "around," "bordering on," "close to," "essentially," "in the neighborhood of" "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

By "non-rotatably connected" elements, we mean that: the elements are connected so that whenever one of the elements rotate, all the elements rotate; and relative rotation between the elements is not possible. Radial and/or axial movement of non-rotatably connected elements with respect to each other is possible, but not required.

Adverting now to the figures, it should be appreciated that the figures depict various embodiments of the present fall arrest apparatus. The elevated work surface, e.g., roof, the falling object, e.g., a worker, a tool, a container filled with materials, etc., and a top surface on the cart to which a present fall arrest apparatus in secured are not shown in the figures. One of ordinary skill in the art will readily appreciate the type, form and arrangement of each of the foregoing structures and therefore depiction in the figures is unnecessary. For the purpose of clarity in the detailed description, these structures are not included in the figures; however, the structures are discussed herebelow.

The present invention broadly includes a fall arrest apparatus, e.g., fall arrest apparatus 50. Apparatus 50 comprises force damping subsystem 52, brake release mechanism 54 and brake mechanism 56. Subsystem 52 comprises damper 58. Brake release mechanism 54 is connected to force damping subsystem 52 and is arranged to trigger when a force having a sufficient magnitude is transmitted to brake release mechanism 54. A more detailed description of a force having a sufficient magnitude is included infra. Brake mechanism 56 comprises energy storage device 60 arranged to deploy at least one anchor, e.g., anchors 62, when brake release mechanism 54 is triggered. The force is provided by a falling object (not shown) to force damping subsystem 52. Force damping subsystem 52 is arranged to decelerate the falling object after brake release mechanism 54 is triggered.

In some embodiments, fall arrest apparatus 50 comprises connector 64. In some embodiments, connector 64 comprises first side 66 oppositely disposed relative to second side 68. As can be seen in the figures, connector 64, in some embodiments, is arranged between force damping subsystem 52 and brake release mechanism 54. It should be appreciated that although in the embodiments depicted in the figures, connector 64 is included as a separate element, in other embodiments, shaft 70 of force damping subsystem 52 and shaft 72 brake release mechanism 54 may be integrally formed, i.e., a continuous piece of material, and the features of connector 64, e.g., compression surface 74, are included in the collective integral shaft. In some embodiments, connector 64 comprises first partial through bore 76 arranged in first side 66 and first shaft 70 is fixedly secured to first side 66 of connector 64 in first bore 76. In some embodiments, connector 64 comprises second partial through bore 78 arranged in second side 68 and second shaft 72 is fixedly secured to second side 68 of connector 64 in second bore 78. In some embodiments, connector 64 comprises first partial through bore 76 arranged in first side 66 and second partial through bore 78 arranged in second side 68. In these embodiments, first shaft 70 is fixedly secured to first side 66 of connector 64 in first bore 76 and second shaft 72 is fixedly secured to second side 68 of connector 64 in second bore 78.

In some embodiments, force damping subsystem 52 comprises first mounting bracket 80 and first shall 70. First mounting bracket 80 comprises through bore 82 and first compression surface 84. First shaft 70 is slidingly disposed within through bore 82 of first mounting bracket 80. Damper 58 comprises damper length 86, first shaft 70 is fixedly secured to first side 66 of connector 64, and first side 66 of connector 64 forms second compression surface 74. Damper length 86 is less than the distance between first and second compression surfaces 84 and 74, respectively, i.e., length 88, prior to triggering brake release mechanism 54. Thus, prior to triggering brake release mechanism 54, e.g., by fracturing shear pin 90, first end 92 of damper 58 contacts first compression surface 84 and gap 94 is present between second end 96 of damper 58 and second compression surface 74. After triggering brake release mechanism 54, i.e., after an object begins to fall and shear pin 90 has fractured, second compression surface 74 contacts second end 96 of damper 58 and begins to compress damper 58 between first and second compression surface 84 and 74, respectively. The compression of damper 58 assists with deceleration of the falling object.

In some embodiments, brake release mechanism 54 comprises second mounting bracket 98, second shaft 72, third mounting bracket 100, pawl 102, ratchet 104 and shear pin 90. Second shaft 72 comprises first end 106 opposite second end 108. Second shaft 72 is slidingly disposed within second mounting bracket 98 and second end 108 comprises through bore 110. Third mounting bracket 100 comprises through bore 112. Pawl 102 comprises first end 114 opposite second end 116 and first end 114 comprises through bore 118. Pawl 102 is pivotably secured to third mounting bracket 100 at through bore 112. Ratchet 104 comprises a plurality of teeth engageable by pawl 102, e.g., teeth 120. Second shaft 72 is fixedly secured to second side 68 of connector 64. Through bore 110 of second shaft 72 is in registered alignment with through bore 118 of pawl 102. Shear pin 90 is disposed within through bore 110 of second shaft 72 and through bore 118 of pawl 102. Brake release mechanism 54 is triggered upon fracture of shear pin 90. As used herein, a "force having sufficient magnitude" is intended to mean a force sufficient to fracture shear pin 90. It should be appreciated that various embodiments of apparatus 50 may have different force values, i.e., different shear pins requiring different fracture forces.

In some embodiments, brake mechanism 56 comprises fourth mounting brackets 122, fourth shaft 124 and anchors 62. It should be appreciated that one or more brackets 122 may be included, and in embodiments having only a single bracket 122, the positioning of bracket 122 must permit the free rotation of fourth shaft 124, e.g., a single bracket 122 may be positioned approximately at the middle of the length of shaft 124. Fourth shaft 124 is rotatably disposed within fourth mounting bracket 122. Anchors 62 are fixedly secured to fourth shaft 124. Anchors 62 may include a variety of features designed to maximize the holding force of anchors 62 relative to the work surface. For example, anchors 62 may include chisel tips 126 as depicted in the accompanying figures. Energy storage device 60 rotates fourth shaft 124 thereby deploying anchors 62. In other terms, upon the triggering of brake release mechanism 54, energy storage device 60 causes shaft 124 to rotate in a direction that drives anchors 62 into a work surface, e.g., a roof. In some embodiments, energy storage device 60 is one or more torsion springs, e.g., springs 128. It should be appreciated that prior to use, energy storage device 60 must be tensioned such that upon the triggering of brake release mechanism 54, energy storage device 60 drives anchors 62 downwardly and into the work surface. The foregoing tensioning of energy storage device 60 may be accomplished by a variety of means, e.g., a hand crank installed at an end or at any point along the length of shaft 124.

In some embodiments, the falling object (not shown) is connected to force damping subsystem 52 by a line (e.g., a rope, a cable, a harness, a belt, or a tether). Such connection is made at a first end to the falling object and at the second end to fitting 130 positioned at end 132 of shaft 70.

In view of the foregoing, it should be appreciated that the present disclosure further includes a method of arresting a fall of an object. The method comprises: a) transmitting a force via a connection between the object and force damping subsystem 52, e.g., a rope, a cable, a harness, a belt or a tether; b) transmitting the force to brake release mechanism 54 via connector 64 arranged between force damping subsystem 52 and brake release mechanism 54, wherein connector 64 comprises first side 66 oppositely disposed relative to second side 68; c) triggering brake release mechanism 54 via the force transmitted from force damping subsystem 52; d) actuating brake mechanism 56 with energy storage device 60; and, e) absorbing the force with three damping subsystem 52. In some embodiments, the step of triggering brake release mechanism 54 occurs upon fracture of shear pin 90.

In other terms, present fall arrest system 50 may function as follows. An object falls from a work surface such as a roof. The object is secured to fall arrest system 50 by a connection such as a harness and/or a rope at first end 132 of shaft 70 in force damping subsystem 52. Shear pin 90 fractures thereby permitting pawl 102 to rotate within through bore 112 and out of locking engagement with ratchet 104. As ratchet 104 is no longer prevented from rotating and is fixedly secured to shaft 124, shaft 124 is rotated by energy storage device 60. Rotation of shaft 124 in turn causes the deployment of anchors 62 into the work surface. Subsequently, second compression surface 74 contacts second end 96 of damper 58 and begins to compress damper 58 between first and second compression surfaces 84 and 74, respectively. The compression of damper 58 acts to reduce the forces acting on the falling object, i.e., damper 58 decelerates the falling object.

The present fall arrest apparatus may be installed on a variety of larger devices. For example, in some embodiments, fall arrest apparatus 50 may be installed on the underside of cart 134. It should be appreciated that for clarity, the top surface of cart 134 has been removed from the figures. Typical top surfaces or top plates may be formed from a thick segment of sheet metal and may comprise significant mass, e.g., six hundred pounds (600 lbs.) or more. Mounting brackets 80, 98, 100 and 122 may be secured to frame 136 anchor the top plate of cart 134. Moreover, the cart may include a counter weight positioned above or nearly above anchors 62 to ensure that the downward force of anchors 62 during deployment does not cause undesirable movement of cart 134, e.g., upward or lateral movement. Additionally, the inclusion of counterweights further ensures that sufficient weight will be present in and on cart 134 in order to arrest the momentum of the falling object, e.g., a worker, a tool, a container of materials, etc.

Figure 8:
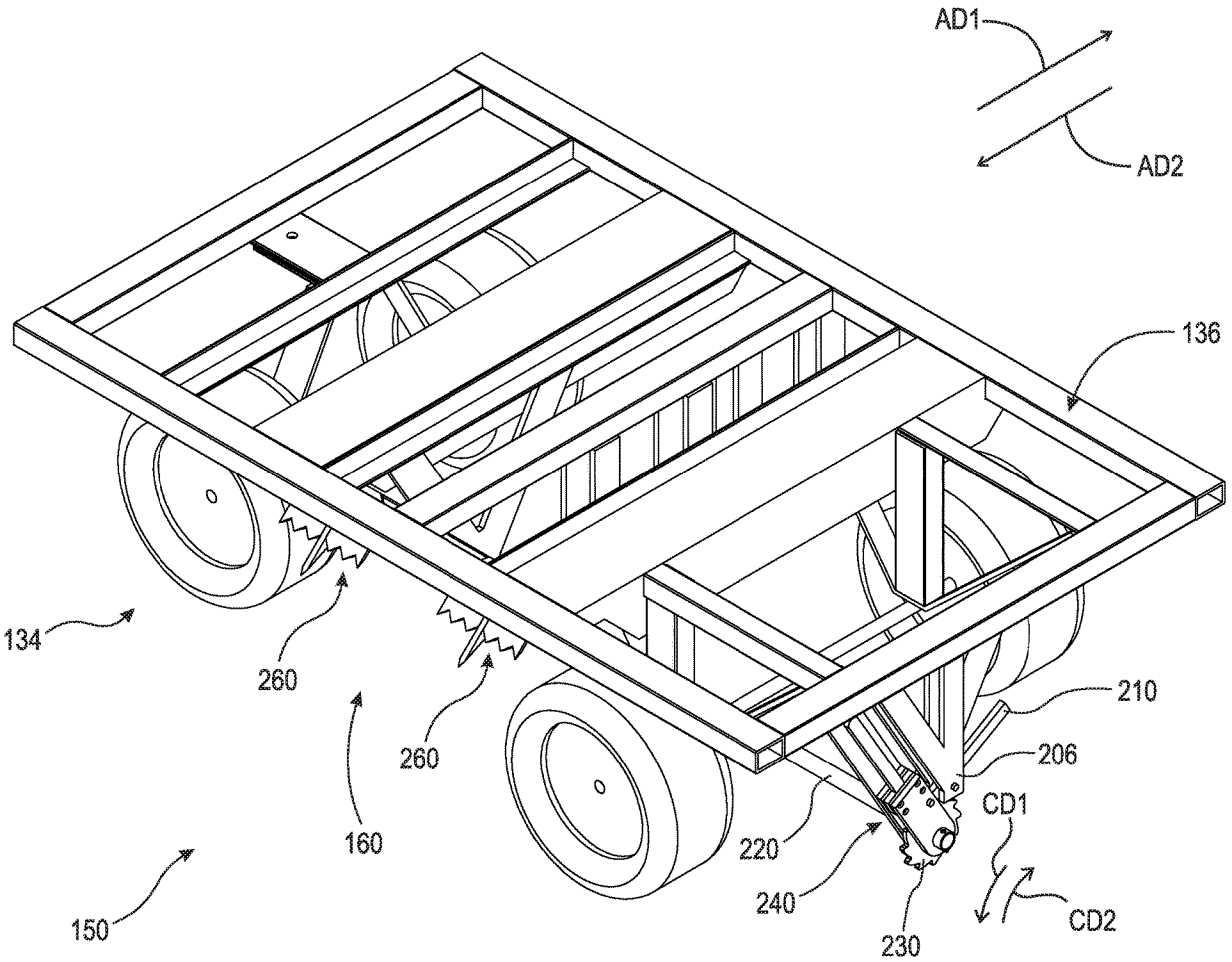
FIG. 8 is a rear top perspective view of a cart having an embodiment of a present fall arrest apparatus secured to the underside of the cart.

The following description should be viewed in light of FIGS. 8-15. FIG. 8 is a rear top perspective view of cart 134 having an embodiment of fall arrest apparatus 150 secured to the underside of cart 134. Fall arrest apparatus 150 is mounted to frame 136 and generally comprises brake mechanism 160, brake release mechanism 200 and force damping subsystem 300.

Figure 9:
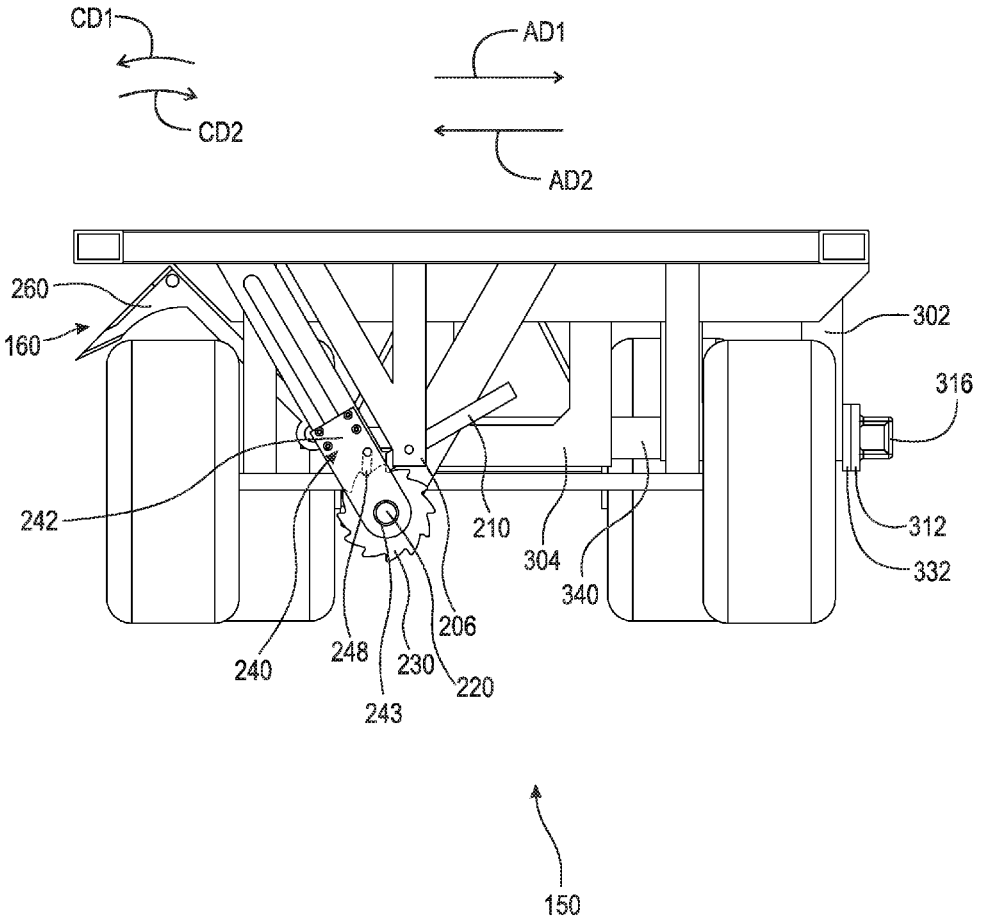
FIG. 9 is a rear elevational view of an embodiment of a present fall arrest apparatus.

FIG. 9 is a rear elevational view of fall arrest apparatus 150. Handle assembly 240 is rotatably secured on first shaft 220 and comprises handle 246, outer brackets 242 which include through bores 243, inner bracket 244, ratchet 230 and pawl 248. Inner bracket 244, ratchet 230 and pawl 248 are secured to, and between, outer brackets 242. Handle 246 is secured to inner bracket 244. Handle assembly 240 operatively engages ratchet 230 with pawl 248. Handle assembly 240 is arranged as a ratchet system to non-rotatably connect to ratchet 230 in circumferential direction CD1 (i.e., pawl 248 engages teeth 232), and to rotate with respect to ratchet 230 in circumferential direction CD2, opposite circumferential direction CD1 (i.e., pawl 248 disengages teeth 232, or in other terms, pawl 248 is permitted to freely pass over teeth 232). Handle assembly 240 is displaced in first circumferential direction CD1 to load energy storage device or torsion spring 270, and can be done repeatedly to load the required amount of force into torsion spring 270. The ratchet and pawl function of handle assembly 240 and ratchet 230 is well known to those having ordinary skill in the art.

Figure 10:
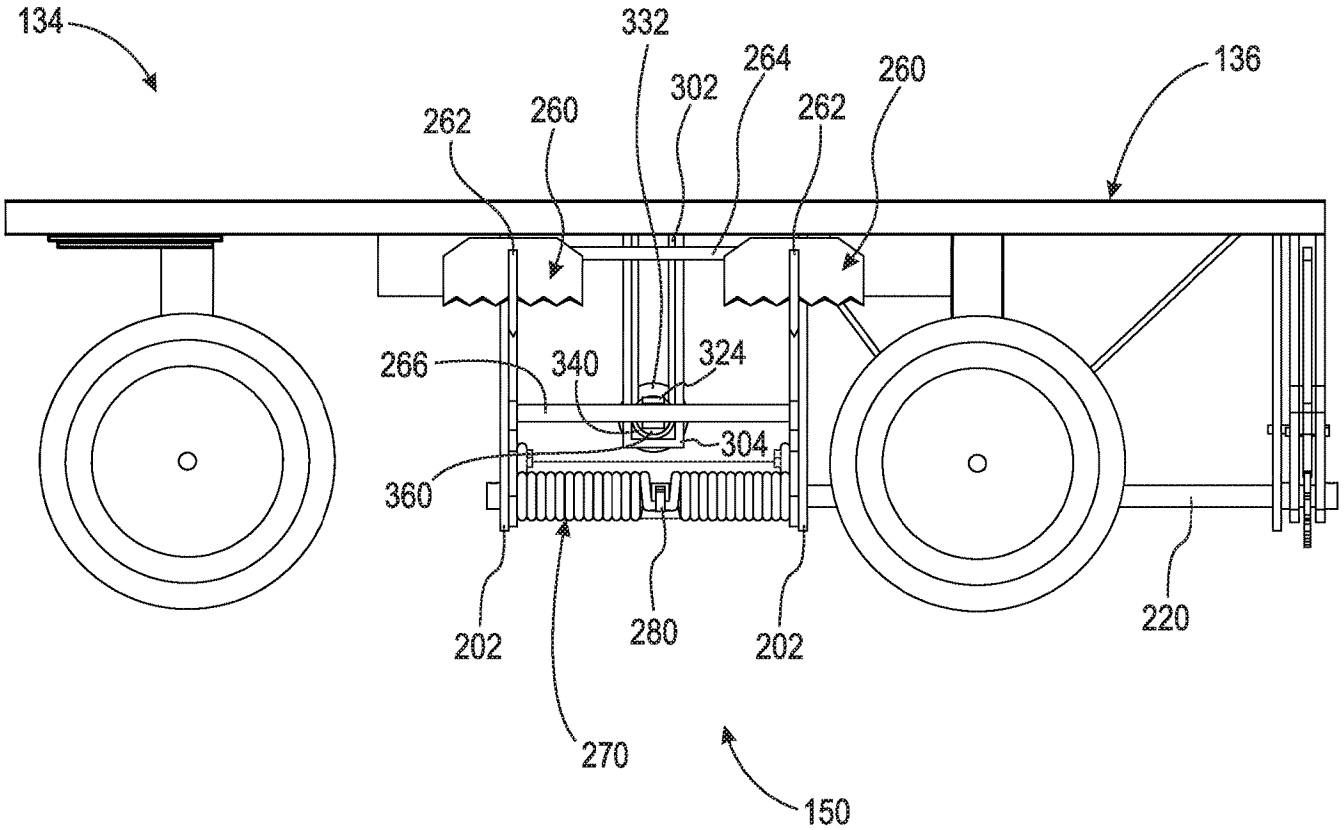
FIG. 10 is a left side elevational view of an embodiment of a present fall arrest apparatus.

FIG. 10 is a left side elevational view of fall arrest apparatus 150. Fall arrest apparatus 150 is generally secured to frame 136 of cart 134 via third mounting brackets 202. As shown, fork portion 324 is engaged with support bar 266. Shear pin 370 has been removed in FIG. 10 to better show the other components of fall arrest apparatus 150. Second tube 340 is secured to second mounting bracket 304. Bushing 360 is arranged within second tube 340. Flange 332 abuts against first mounting bracket 302. Anchors 260 comprise chisel tips 262 and are connected via support bars 264 and 266. Torsion spring 270 is arranged around first shaft 220 and axially between anchors 260. Hook 280, which is fixedly secured to shaft 220, engages torsion spring 270. It should be appreciated that torsion spring 270 may be a single torsion spring or a double torsion spring as required by the arrangement of the system, e.g., a single torsion spring may be used for a system having a single anchor.

Figure 11:
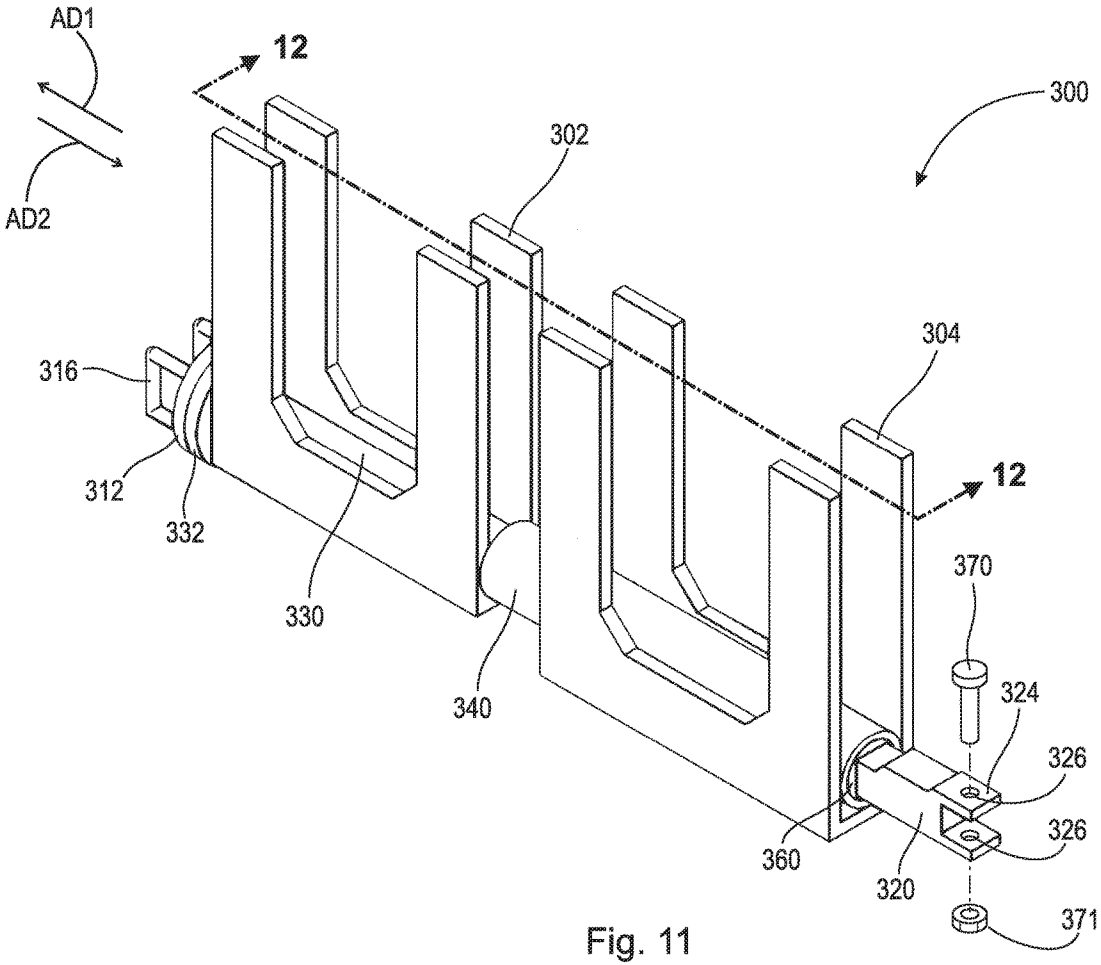
FIG. 11 is a top perspective view of an embodiment of a force damping subsystem used in a present fall arrest apparatus.
Figure 12:
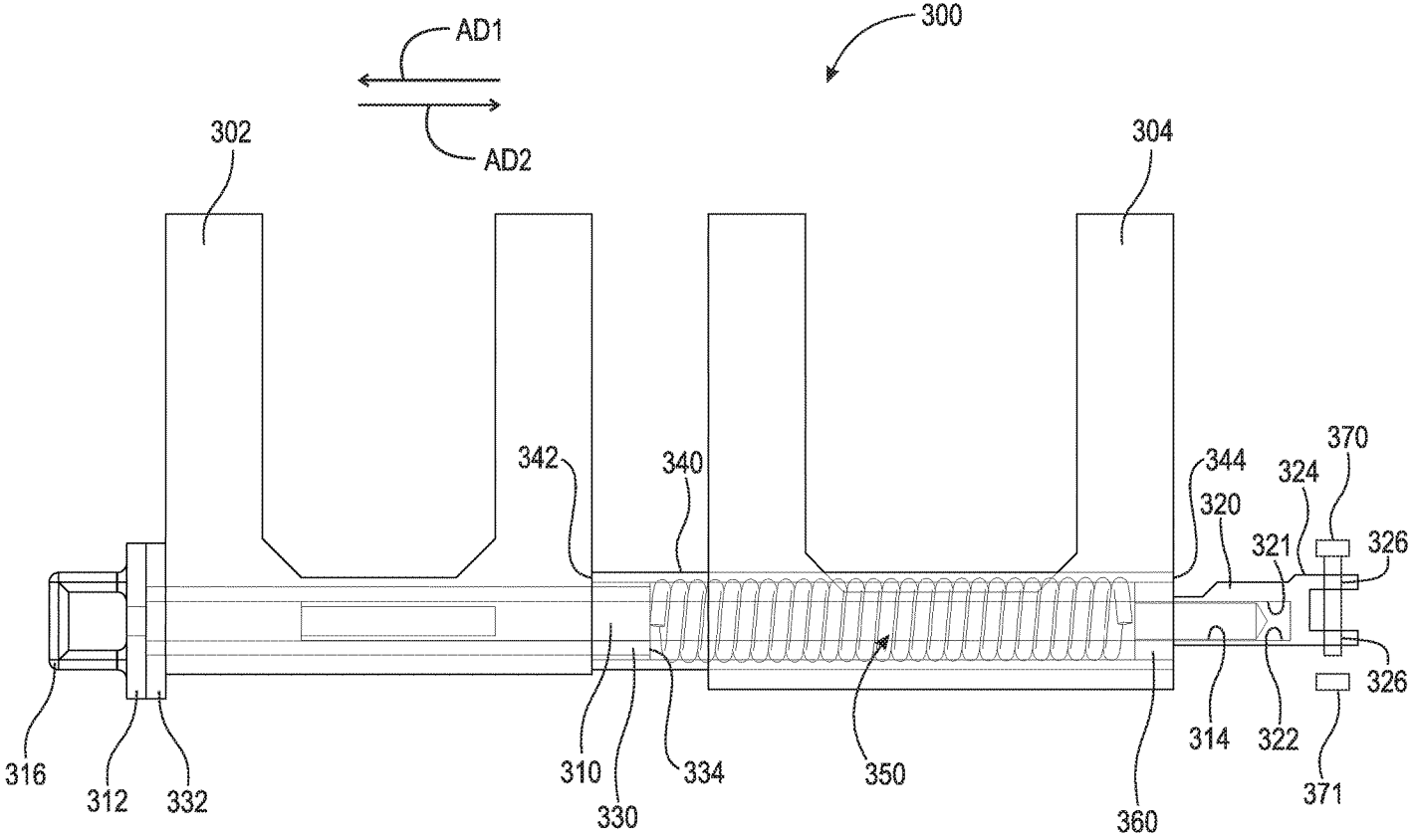
FIG. 12 is a cross-sectional view of the three damping subsystem shown in FIG. 11, taken generally along line 12-12.

FIG. 11 is a top perspective view of force damping subsystem 300 used in fall arrest apparatus 150. FIG. 12 is a cross-sectional view of force damping subsystem 300, taken generally along line 12-12 in FIG. 11. Force damping subsystem 300 comprises first mounting bracket 302, second mounting bracket 304, second shaft 310, third shaft 320, first tube 330, second tube 340, bushing 360, and shear pin 370. First tube 330 is secured to first mounting bracket 302. First tube 330 comprises flange 332 and end 334. Second tube 340 is secured to second mounting bracket 304. Second tube 340 comprises end 342 and end 344. End 342 abuts against, and may be secured to, first mounting bracket 302 as shown in FIGS. 11 and 12. Second shaft 310 is arranged in first tube 330 and second tube 340. Second shaft 310 comprises flange 312, which abuts against flange 332, and outer threads 314. Fitting 316 is secured to flange 312. Third shaft 320 comprises a radially inward facing surface 321 having inner threads 322, fork portion 324, and through bores 326. Third shaft 320 is secured to second shaft 310 via inner threads 322 and outer threads 314. Fork portion 324 engages support bar 266 and secured there around via shear pin 370. Shear pin 370 engages the two fork arms of fork portion 324 via through bores 326. Shear pin 370 may optionally be secured to fork portion 324 with securing device 371. Securing device 371 may be a nut, cotter pin, clamp, or any other suitable device for securing shear pin 370 in fork portion 324. Bushing 360 is arranged around second shaft 310 and within second tube 340. Third shaft 320 abuts against bushing 360. Damper 350 is arranged around second shaft 310 and within second tube 340. Damper 350 is a compression spring that abuts against end 334 at a first end and bushing 360 at a second end. However, it should be appreciated that damper 350 may be any suitable means for damping a linear force, e.g., a resilient polymer such as rubber or the like, a leaf spring, a shock absorber (gas, oil or air charged), a stitched nylon tether, a stretchable cable, a tension spring, etc., and such variations fall within the scope of the claims below. In some embodiments, the falling object (not shown) is connected to force damping subsystem 300 by a line, for example, a rope, cable, harness, belt, or tether. Such connection is made at a first end to the falling object (e.g., a person) and at the second end to fitting 316. In the event of a fall, fitting 316 is pulled in axial direction AD1. When there is enough force to break shear pin 270, brake release mechanism 200 is activated. In such an event, second shaft 310 pulls third shaft 320, and thus bushing 360, in axial direction AD1 and damper 350 is compressed to help soften the impact on the falling object, i.e., damper 350 imparts a force on bushing 360 in axial direction AD2.

Figure 13:
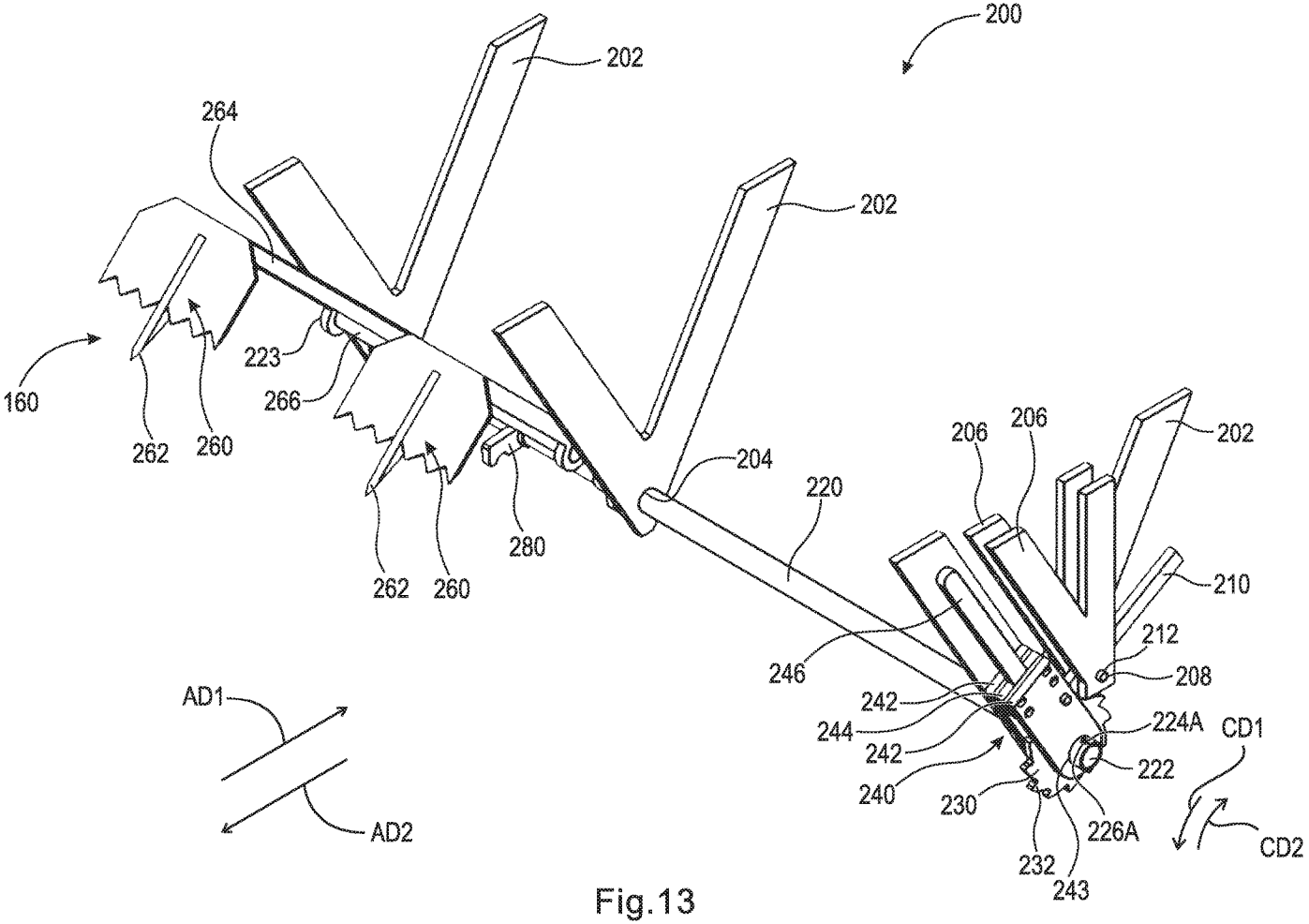
FIG. 13 is a top perspective view of an embodiment of a brake release mechanism used in a present fall arrest apparatus.
Figure 14:
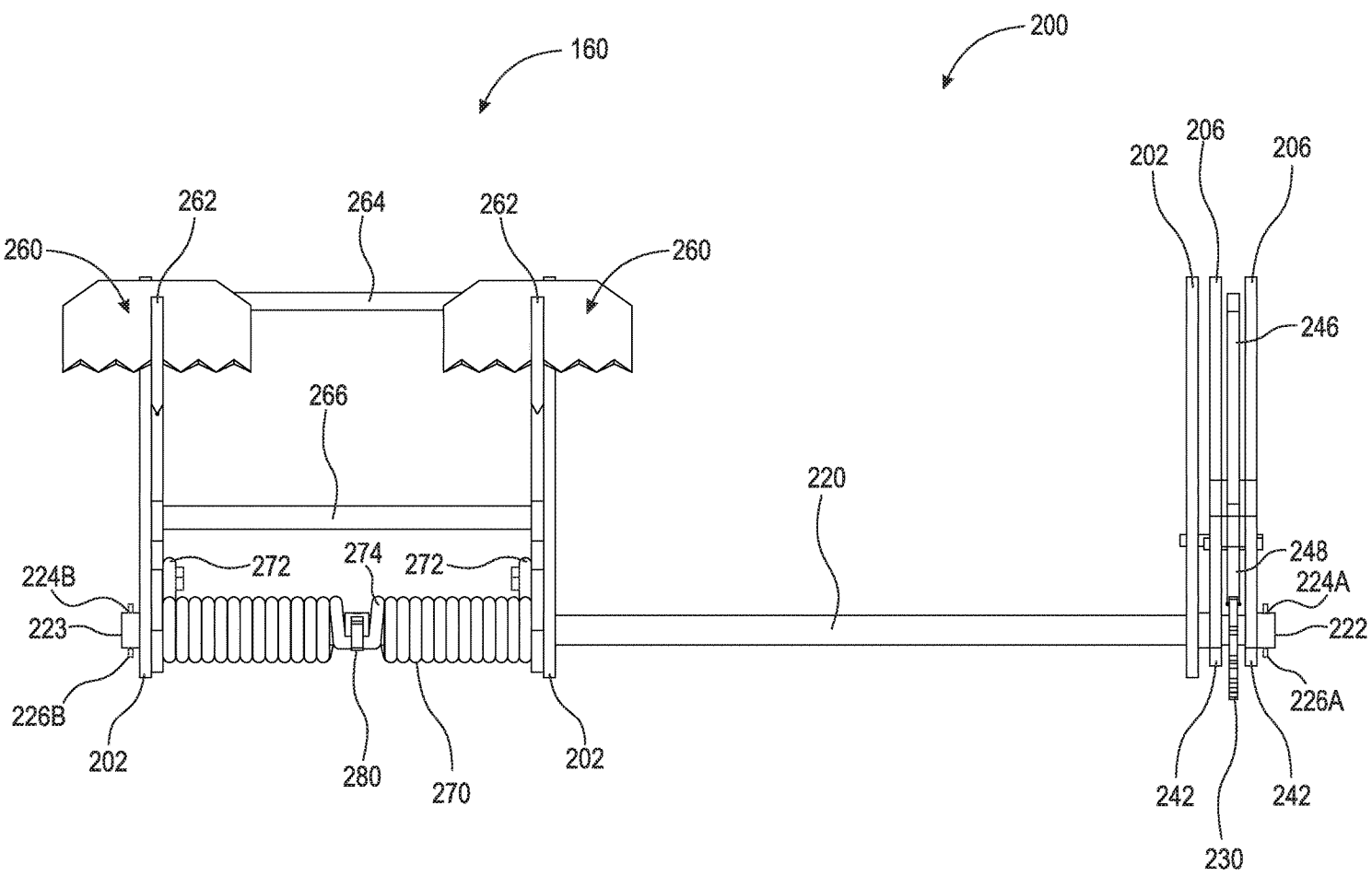
FIG. 14 is a side elevational view of the brake release mechanism shown in FIG. 13; and, FIG. 15 is a top perspective view of an embodiment of a fall arrest apparatus showing a force damping subsystem engaged with a brake release mechanism with the cart removed for clarity.

FIG. 13 is a top perspective view of brake release mechanism 200 used in fall arrest apparatus 150. FIG. 14 is a side elevational view of brake release mechanism 200. Brake release mechanism 200 comprises third mounting brackets 202 having through bores 204, fourth mounting brackets 206 having through bores 208, pawl 210, ratchet 230, handle assembly 240, first shaft 220, anchors 260, torsion spring 270, and support bars 264 and 266. Torsion spring 270 is removed in FIG. 13 to better show other features of brake release mechanism 200. First shaft 220 is secured to frame 136 via third mounting brackets 202. First shaft 220 is rotatable within through bores 204 of third mounting brackets 202. First shaft 220 is secured in an axial direction using any suitable method known in the art. In an example embodiment, first shaft 220 comprises through bore 224A at first end 222 and through bore 224B at second end 223. Pins 226A and 226B engaged through bores 224A and 224B to secure first shaft 220 in an axial direction. Pawl 210 is secured to frame 136 via fourth mounting brackets 206. Pawl 210 is rotatably connected to fourth mounting brackets 206 via pin 212, which engages through bores 208. Pawl 210 is operatively arranged to engage teeth 232 such that, when engaged, it allows ratchet 230 to move in circumferential direction CD1 but prevents ratchet 230 from moving in circumferential direction CD2. Pawl 210 can be disengaged from teeth 232 to allow ratchet to move in circumferential direction CD2. Pawl 210 is used to rotationally secure ratchet 230 while handle assembly is rotated in circumferential direction CD2. Teeth 232 are arranged completely around ratchet 230. In some embodiments, teeth 232 are arranged only partially around ratchet 230. Hook 280 is non-rotatably secured to first shaft 220 and arranged axially between anchors 260. Hook 280 may be secured to first shaft 220 by any suitable method, for example, a bolt or pin, or a weld. Torsion spring 270 is arranged around first shaft 220. Torsion spring 270 comprises ends 272 and middle loop 274. Ends 272 are secured to anchors 260 and middle loop is secured to hook 280. Anchors are rotatably secured to first shaft 220. Anchors 260 are secured together via support bars 264 and 266. Fork portion 324 engages support bar 266 and is secured there around via shear pin 270 (see discussion of FIG. 15 below). Anchors 260 may further comprise chisel tips 262. Anchors 260 and chisel tips 262 are designed to engage and/or pierce the surface of the roof on which cart 134 rests to provide added fall security.

Figure 15:
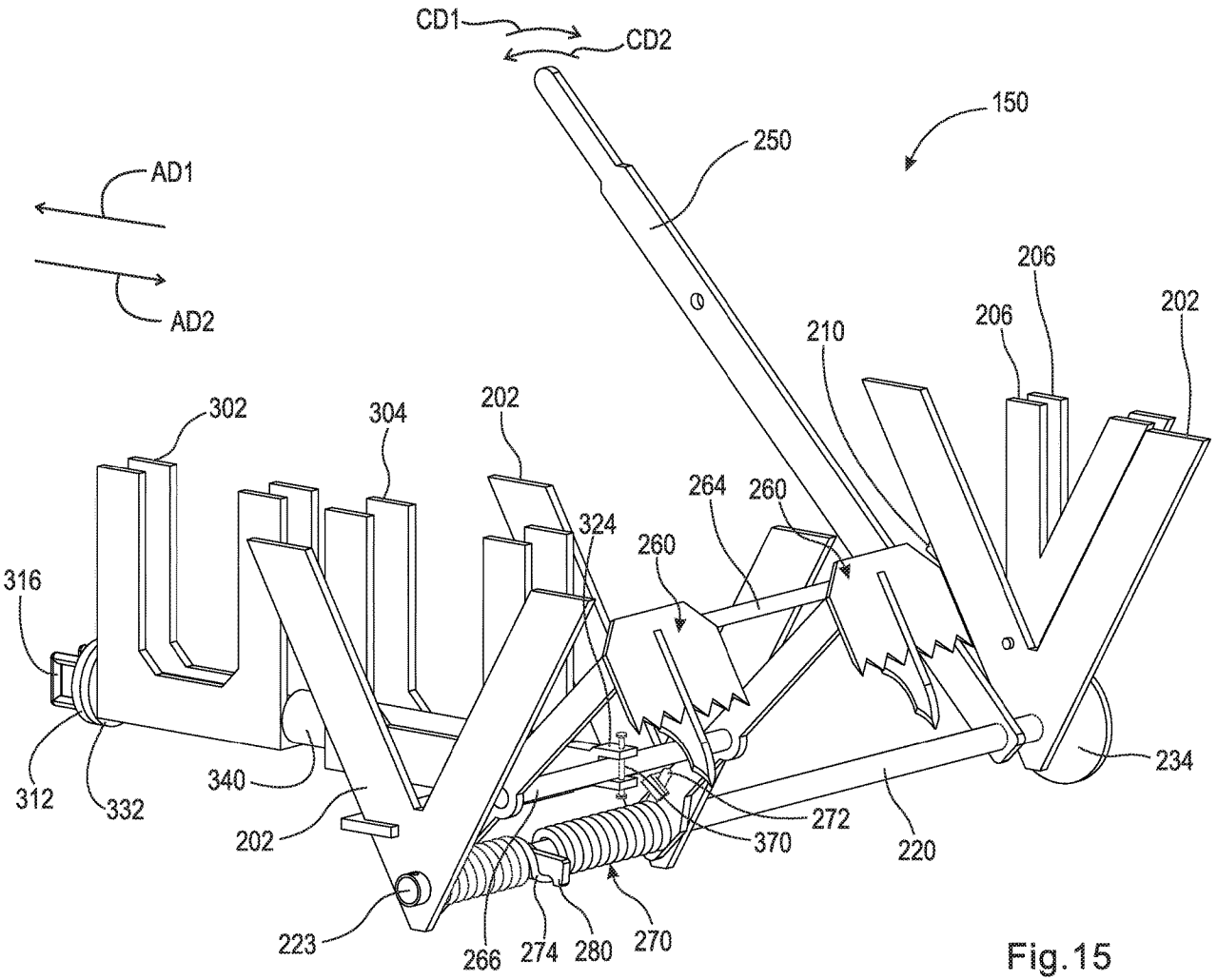

FIG. 15 is a top perspective view of an embodiment of fall arrest apparatus 150 showing force damping subsystem 300 engaged with brake release mechanism 200. As shown, anchors 260 are set in an elevated position and fork portion 324 is engaged with support bar 266. Shear pin 370 is then secured in fork portion 324. Torsion spring 270 is arranged around first shaft 220 axially between anchors 260. Ends 272 are secured to anchors 260. It should be appreciated that although torsion spring 270 is depicted as being secured to anchors 260 via tab like structures, ends 272 of spring 270 may be secured to anchors 260 by any means known in the art, e.g., by positioning ends 272 above support bar 266, by welding ends 272 to anchors 260, etc. Hook 280 engages middle loop 274. FIG. 15 shows ratchet 234. Ratchet 234 comprises teeth 236 (not shown). Teeth 236 are arranged only partially around ratchet 234. In some embodiments, teeth 236 are arranged completely around ratchet 234, while in some embodiments teeth 236 are arranged partially around ratchet 234, e.g., about one quarter of the circumference. Handle 250 is non-rotatably connected to first shaft 220. FIG. 15 shows handle 250 in a first position, at which fall arrest apparatus 150 is not loaded. To load fall arrest apparatus 150, handle 250 is displaced in circumferential direction CD1 to a second position (i.e., a loaded position), at which sufficient force is loaded into torsion spring 270. By sufficient force, it is meant that when shear pin 370 breaks and fork portion 324 disengages support bar 266, torsion spring 270 causes anchors 260 to rotate in circumferential direction CD1 with enough force to engage and/or pierce the surface of the roof on which cart 134 rests to provided added fall security.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A fall arrest apparatus configured to be used on a surface, the fall arrest apparatus comprising: a force damping subsystem comprising a damper;

a brake release mechanism connected to the force damping subsystem and arranged to trigger when a force having a sufficient magnitude is transmitted to the brake release mechanism; and, a brake mechanism comprising an energy storage device arranged to deploy at least one anchor when the brake release mechanism is triggered, wherein said anchor is configured to engage said surface when said anchor is deployed and wherein said anchor does not contact the surface prior to deployment, wherein the force is provided by a falling object attached to the force damping subsystem and the force damping subsystem is arranged to decelerate the falling object after the brake release mechanism is triggered.

2. The fall arrest apparatus of claim 1 further comprising:

a connector comprising a first side oppositely disposed relative to a second side and arranged between the force damping subsystem and the brake release mechanism.

3. The fall arrest apparatus of claim 2 wherein the force damping subsystem comprises:

a first mounting bracket comprising a through bore and a first compression surface; and, a first shaft slidingly disposed within the through bore of the first mounting bracket, wherein the damper comprises a damper length, the first shaft is fixedly secured to the first side of the connector, the first side of the connector forming a second compression surface, the damper length is less than the distance between the first and second compression surfaces prior to triggering the brake release mechanism.

4. The fall arrest apparatus of claim 3 wherein the connector comprises a first partial through bore arranged in the first side and the first shaft is fixedly secured to the first side of the connector in the first partial through bore.

5. The fall arrest apparatus of claim 2 wherein the brake release mechanism comprises:

a second mounting bracket;

a second shaft comprising a first end opposite a second end, the second shaft slidingly disposed within the second mounting bracket, the second end comprising a through bore;

a third mounting bracket comprising a through bore;

a pawl comprising a first end opposite a second end, the first end comprises a through bore;

a ratchet comprising a plurality of teeth engageable by the pawl; and, a shear pin, wherein the second shaft is fixedly secured to the second side of the connector, the through bore of the second shaft is in registered alignment with the through bore of the pawl, the shear pin is disposed within the through bore of the second shaft and the through bore of the pawl, and the brake release mechanism is triggered upon fracture of the shear pin.

6. The fall arrest apparatus of claim 5 wherein the connector comprises a second partial through bore arranged in the second side and the second shaft is fixedly secured to the second side of the connector in the second partial through bore.

7. The fall arrest apparatus of claim 1 wherein the force damping subsystem comprises:

a bracket fixedly secured to an object, the bracket comprising a first surface;

a shaft slidingly secured to the bracket, the shaft comprising:

a first shaft end operatively arranged to connect to the falling object; and, a second shaft end having a stop; and, the damper comprising:

a first damper end abutting against the first surface; and, a second damper end abutting against the stop.

8. The fall arrest apparatus of claim 7 wherein the damper is operatively arranged around the shaft.

9. The fall arrest apparatus of claim 7 wherein the brake release mechanism comprises:

a fork portion fixedly secured to the second shaft end and comprising first and second fork arms, the first fork arm comprising a first fork arm through bore and the second fork arm comprising a second fork arm through bore, the first and second fork arm through bores in alignment; and, a shear pin disposed within the first and second fork arm through bores, wherein the first and second fork arms capture a portion of the energy storage device and the shear pin, in part, maintains the portion of the energy storage device within the fork portion.

10. The fall arrest apparatus of claim 1 wherein the brake mechanism comprises:

at least one fourth mounting bracket;

a fourth shaft disposed within the at least one fourth mounting bracket; and, at least one anchor fixedly secured to the fourth shaft, wherein the energy storage device rotates the fourth shaft thereby deploying the at least one anchor.

11. The fall arrest apparatus of claim 1 wherein the energy storage device comprises a torsion spring.

12. The fall arrest apparatus of claim 1 wherein the falling object is connected to the force damping subsystem by a rope, a cable or a tether.

13. The fall arrest apparatus of claim 1 wherein the falling object is connected to the force damping subsystem by a harness or a belt.

* * * * *